United States Patent [19]

Brutsaert

[11] Patent Number: 4,997,021

[45] Date of Patent: Mar. 5, 1991

[54] COLLAPSIBLE AWNING

[76] Inventor: Louis Brutsaert, Kortrijksestraat 426, Menen 8600, Belgium

[21] Appl. No.: 323,484

[22] Filed: Mar. 14, 1989

[30] Foreign Application Priority Data

Aug. 8, 1988 [FR] France ..... 88 10961
Sep. 30, 1988 [BE] Belgium ..... 8801124

[51] Int. Cl.[5] ..... E04F 10/00

[52] U.S. Cl. ..... 160/22; 160/72; 135/89

[58] Field of Search ..... 160/22, 46, 66, 69, 160/70, 72, 78, 79; 135/89; 16/371, 367

[56] References Cited

U.S. PATENT DOCUMENTS 743,711 11/1903 Gaylord ..... 160/72
3,866,874 2/1975 Upton, Jr. ..... 160/72 X
4,171,013 10/1979 Clark ..... 135/89 X
4,469,159 9/1984 Lohausen ..... 160/22
4,518,162 5/1985 Oates ..... 403/349 X
4,566,516 1/1986 Lohausen ..... 160/22
4,733,683 3/1988 Pozzi ..... 160/22 X
4,784,204 11/1988 Lohausen ..... 160/22

FOREIGN PATENT DOCUMENTS 2504806 8/1975 Fed. Rep. of Germany ..... 160/22
2753979 6/1979 Fed. Rep. of Germany ..... 160/22

*Primary Examiner*—Blair M. Johnson
*Attorney, Agent, or Firm*—James Creighton Wray

[57] ABSTRACT

A collapsible awning is assembled from various elements. An awning case has supporting brackets. A roll-up shaft has one end of the awning fabric fixed thereon. On the other end of the fabric a front lead rail is fixed. The front rail closes the awning case, when the awning is completely rolled up. Stretching arms are used to maintain the front rail outward and the awning fabric stretched during the up and down movement of the awning. A locking device holds the awning in the awning case. A driving device connected to the roll-up shaft is electrically or mechanically controlled.

12 Claims, 5 Drawing Sheets

COLLAPSIBLE AWNING

BACKGROUND OF THE INVENTION

This invention concerns collapsible awnings which are stored in a mounted awning case.

In a previous patent application (FR 87-04025) an awning was described in which the front lead rail was provided with a retractable pawl sliding within the front lead rail. The pawl locked the front lead rail within an aperture provided in the awning case, when the awning was rolled up to be closed.

That locking device required separate devices for rolling up and for locking the awning.

A need exists for a collapsible awning with automatic case locking and unlocking when an awning is moved to and from a stored position.

Another feature of the collapsible awning according to the invention concerns the mounting brackets of the awning box. A large number of collapsible awnings are used for vans, campers, motor homes and so forth. A problem exists in how to attach the awning box to the body of a vehicle. Usually the bodies are curved inward according to various designs. The awning box has to be maintained in a vertical position.

SUMMARY OF THE INVENTION

A collapsible awning is assembled from various elements. An awning case has mounting brackets. A rolling shaft has one end of the awning fabric fixed thereon. On the other end of the fabric a front lead rail is fixed. The front rail closes the awning case, when the awning is completely rolled up. Stretching arms are used to maintain the front rail outward and the awning fabric stretched during the up and down movement of the awning. A locking device holds the awning in the awning case. A driving device connected to the rolling shaft is electrically or mechanically controlled.

A first purpose of the invention is to provide a locking device when is automatically controlled by rolling up or down the awning fabric.

The locking device of the collapsible awning according to the invention is characterized by a front lead rail including a step corresponding to the latch of the locking device mounted on the awning case and controlled by the awning shaft according to the up and down movement of the awning fabric.

Another purpose of the collapsible awning according to the invention is to provide an awning in which the vertical mounting hinges of the stretching arms, on which said front lead rail is fixed, can hinge in the awning case according to the position of said front lead rail during its up and down movement.

The vertical mounting hinges of the stretching arms of the collapsible awning according to the invention are characterized by two extension pins, a pivot pin and a guiding pin. The clutching pin is parallel to the rolling shaft and is introduced within a bearing of the side plate of the awning case. The vertical mounting hinges of the stretching arms hinge around the pivot pin. The guiding pin moves within a groove provided in the side plate of the awning case.

Another purpose of the collapsible awning according to the invention, when said awning is mechanically controlled, is to provide a coupling device which can be easily manipulated by a handle. The handle is introduced in or removed from said coupling device without difficulty and is strongly fixed to said coupling device while operating the awning shaft.

The coupling device of the collapsible awning according to the invention includes a transforming device for changing the rotating movement of the horizontal rolling shaft of said awning to a rotating movement of a vertical stub shaft. The lower end of the vertical stub shaft is provided with a cylindrical casing. The cylindrical casing is provided with at least one guiding J-shaped groove. The J-shaped groove has at one lower end an aperture to receive a horizontal pin provided on the top of the handle. The other lower end of the J-shaped groove is closed. Thereby the handle is fixed within the coupling device according to the invention. After only a little upward moving of the horizontal pin of the handle and rotating the horizontal pin within the groove to the other lower end, the horizontal pin will drop by the handle weight.

By further rotating the handle in one or the other direction, said vertical stub shaft and accordingly the horizontal rolling shaft will rotate in one or the other direction rolling up or down said awning fabric.

Other features, improvements, and advantages of the collapsible awning according to the invention will appear from the above and ongoing description of an awning including the various elements according to the invention. This description refers to the accompanying figures.

DETAILED DESCRIPTION OF THE DRAWINGS

Figure 1:
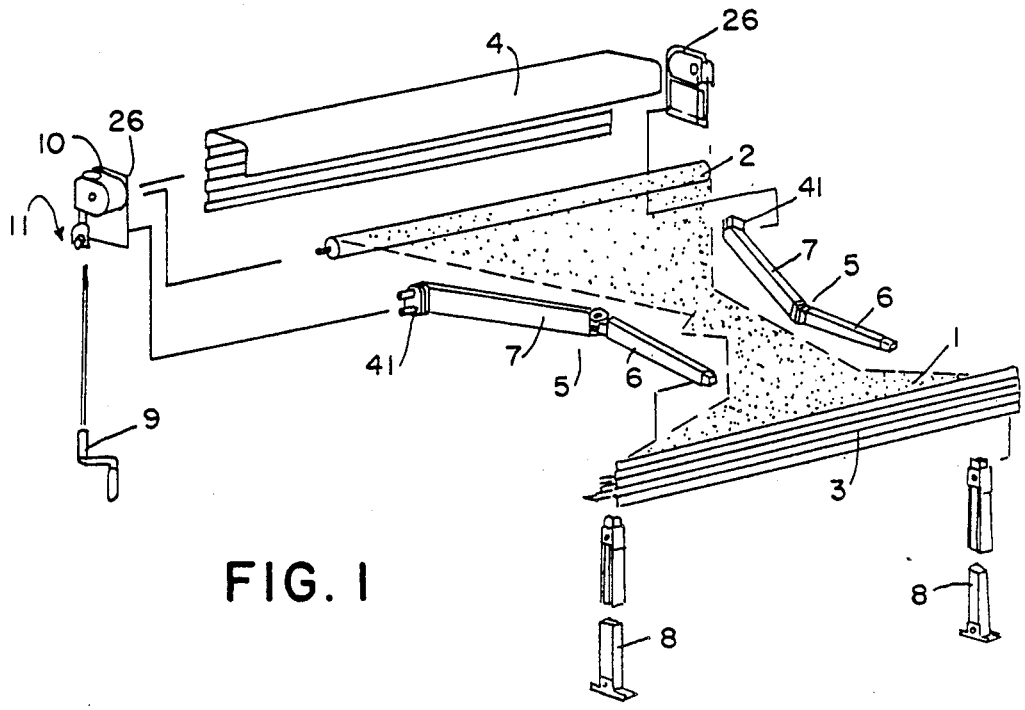
FIG. 1 is an exploded view of an awning according to the invention.

A collapsible awning as it is represented in its various elements as shown in FIG. 1 includes a woven fabric 1 fixed at one end to a rolling shaft 2 and at the other end on a front head rail profile 3.

When the woven fabric 1 of the collapsible awning is rolled up or down, the awning is stretched in its deploy position on both sides by means of stretching arms 6, 7 coupled together by medial hinges 5. When the awning is in its rolled-up position, the stretching arms 6, 7 fold about the medial hinges 5. In the most extended position, rail 3 is supported by two brackets vertical supports 8. Vertical supports 8 are connected to the rail 3 and extend downward to support the front rail.

The rolling shaft 2 can be driven electrically or mechanically by hand. In the awning as represented in FIG. 1, shaft 2 is driven by a handle 9 that drives a gear fixed on the rolling shaft 2 within a gearbox 10 by means of coupling device 11.

The gearbox 10 is fixed on one of the side plates 26 of the awning box.

Figure 2:
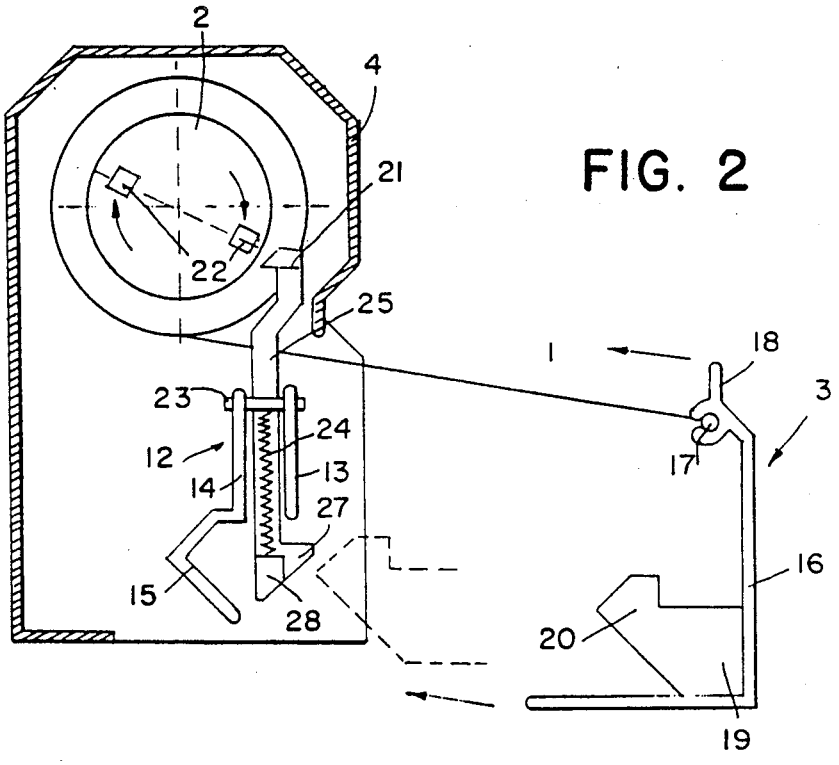
FIG. 2 is a sectional view of an awning according to the invention during the rolling-up movement of the front lead rail.
Figure 3:
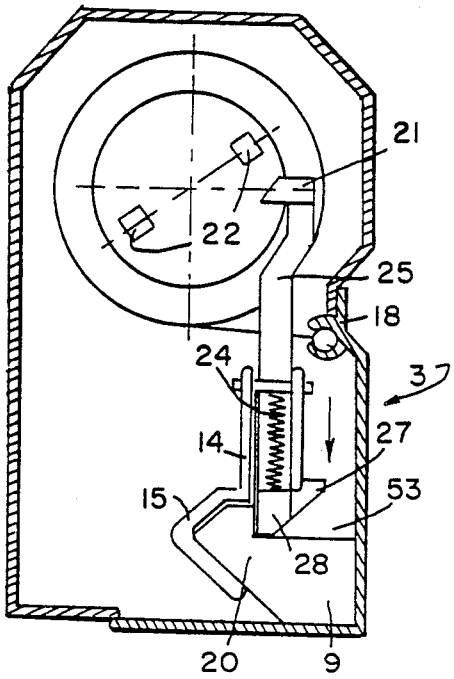
FIG. 3 is a sectional view of the same awning according to the invention as represented in FIG. 2 in a closed position.
Figure 4:
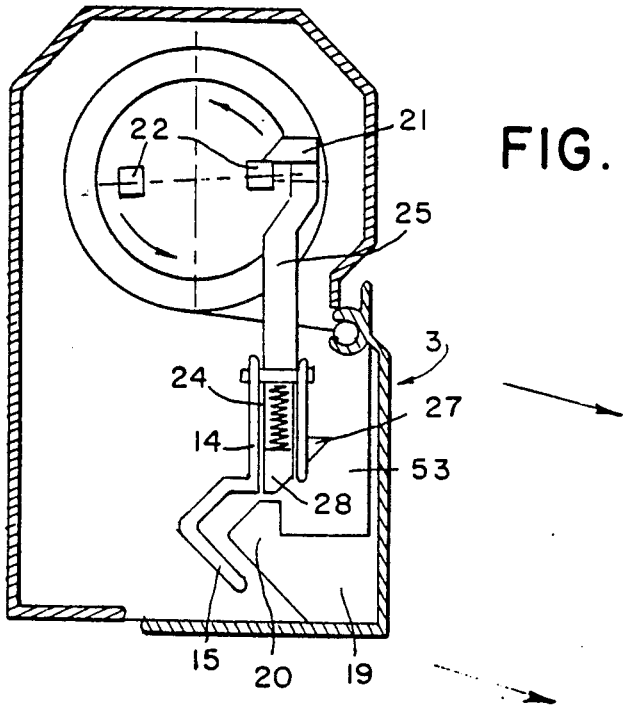
FIG. 4 is a sectional view of the same awning according to the invention as represented in FIGS. 2 and 3, when the front lead rail is in a downward movement.

Details of a collapsible awning according to the invention are represented in FIGS. 2, 3 and 4. Woven fabric 1 is fixed to front head rail profile 3 by a bar that has been introduced in a groove 17 of the front profile 3.

Front profile 3, near the groove 17, includes an angular profile 16. The end of the front leg of the profile 16 is a stop part 18 that comes against the front part of the main awning box plate 4 when the woven fabric 1 is rolled up. The awning box 4 is closed with the lower leg of the profile 16.

At one or at each end of said front profile 3, within the corner of said angular profile 16, there is a clasp 19 with a step 20. Corresponding to said clasp 19 and step 20, on the side plate 26 of the awning box 4, there is a locking device 12 fixed to said side plate 26 and composed by two guiding plates 13, 14 fixed together by a crossing bar 23. Back guiding plate 14 is extended by a hook plate 15 in which step 20 of clasp 19 of the front profile 3 is introduced by closing the awning box 4 when the woven fabric 1 is rolled up.

Within the guiding device 12, there is a sliding vertical finger 25. The upper end of finger 25 is constituted by a hook 21, and the lower end has a pin 28. Pin 28 is pushed downward by a spring 24 fixed to the cross bar 23 of the locking device 12.

When the woven fabric 1 is rolled up, as is represented in FIG. 3, pin 28 lies in a lower portion of the latch 27 under the pressure of spring 24. When front profile 3 comes nearer the awning box 4, step 20 of clasp 19 of said front profile 3 is introduced in the free space 53. Step 20 pushes the pin 28 and the sliding finger 25 against the pressure of spring 24 as step 20 comes to the end of its movement along the hook plate 15 of the locking device 12. At this stage (FIG. 3), pin 28 of the sliding finger 25 comes down under the pressure of spring 24 after the step 20 of clasp 19, holding the front profile 3 against the main awning box plate 4 and closing the awning box.

When the rolling shaft 2 is rotated counter-clockwise to roll down the woven fabric 1 (FIG. 4), lug 22, fixed to the rolling shaft 2, grips hook 21 of the sliding finger 25. Pressure spring 24 is not completely extended, because sliding finger 25 lies on a clasp 19. Therefore, lug 22 pulls the sliding finger 25 upward with pin 28, against the pressure of spring 24, which frees step 20 and clasp 19 and allows profile 3 to be pulled downward.

Figure 5:
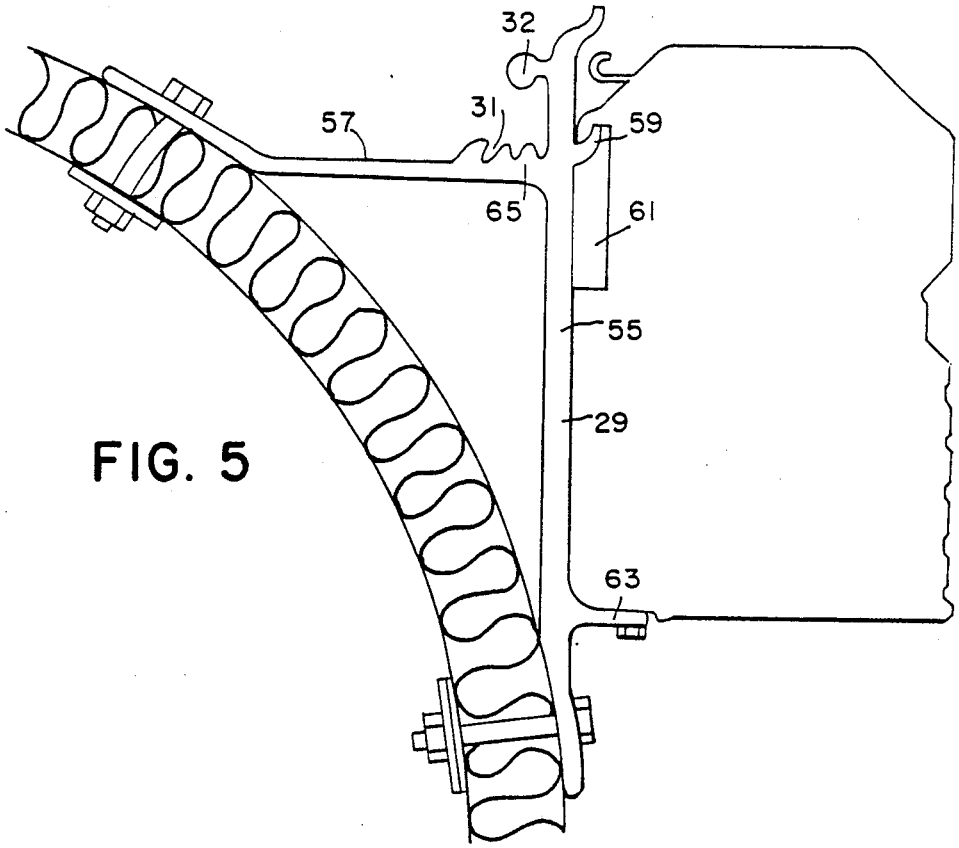
FIG. 5 is a schematic sectional view of an awning case according to the invention fixed on a curved surface like that of a car.
Figure 6:
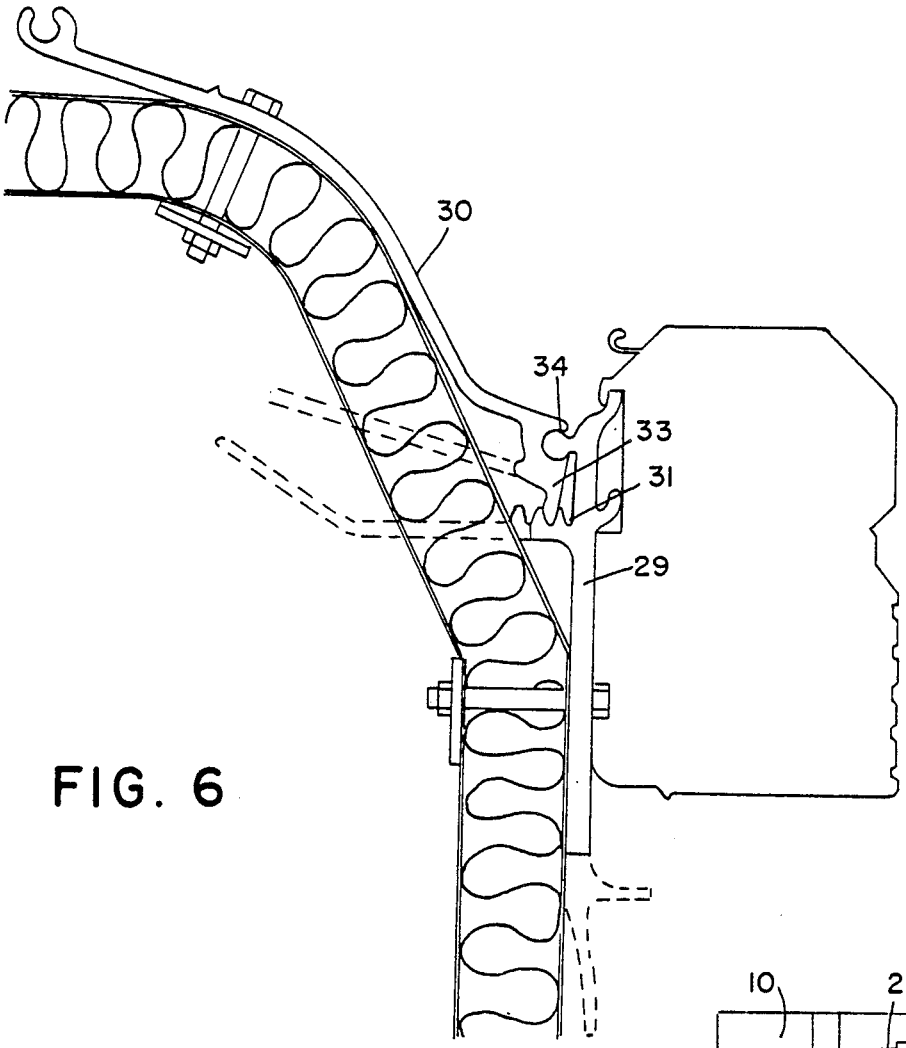
FIG. 6 is a schematic sectional view of an awning case according to the invention fixed to another inward curved surface.

The collapsible awning according to the invention is provided with brackets as represented in FIGS. 5 and 6 to attach the awning box to inward curved surfaces of vehicles such as roof sides of campers, vans, trailers and motor homes.

In FIG. 5, the body to which the collapsible awning has to be fixed has a regular shape. A basic profile 29 is used. Profile 29 has an angular cross section with a first vertical portion 55 and a second horizontal portion 57. The vertical portion has an extension 59 fitting within a groove 61 in the upper end of the rear wall of the awning case. The horizontal and vertical portions terminate in a concave end with a hole for a mounting bolt for connections to the body. On the lower section of the vertical portion 55 there is an extension 63 beneath the awning case. The horizontal portion is permanently attached to the vertical portion at the upper section of the vertical portion.

The vertical portion 55 of basic profile 29 is provided with a support extension 65 and this support extension 65 has at least one groove 31 and the vertical portion 55 is provided with an articulation rib 32 for the case of more complex body shapes, as represented in FIG. 6. In that case, the most common one, the basic profile 29 is combined with an adapting profile 30, which is provided with a downward projecting rib 33 at one end that can be introduced in one of said grooves 31 of the basic profile 29, according to the shape of the particular body. The unused parts of the horizontal and vertical portions of the basic profile 29 are cut off. Adapting profile 30 has a groove 34 completely filled by articulation rib 32 of the basic profile 29. Adapting profile 30 takes the required position regarding the shape of the body to mount the awning box with the corresponding bolts.

Figure 7:
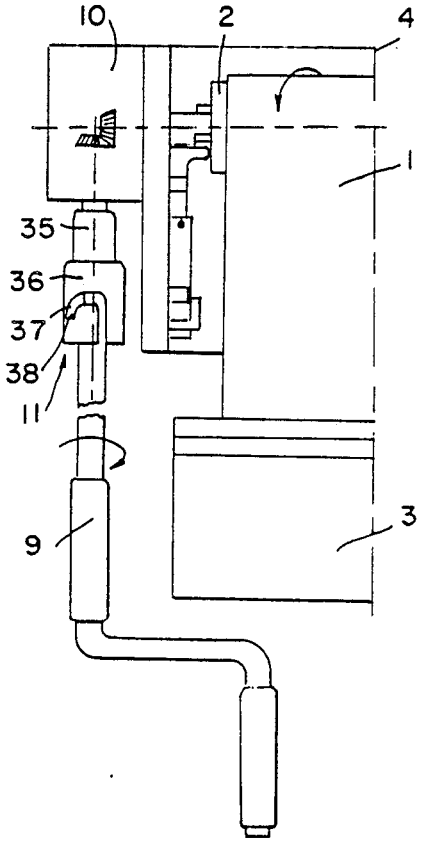
FIG. 7 is a schematic sectional view of a coupling device of a collapsible awning according to the invention.

Another feature of the collapsible awning according to the invention concerns a mechanical driving device of the rolling shaft 2 which is shown in FIG. 7. Usually at one end of said rolling shaft 2 there is a gear fixed on said shaft 2 within a gearbox 10. The rolling shaft is driven by a vertical stub shaft 35, on which at its upper end is another fixed a second gear in the gearbox 10.

Usually on the lower end of said vertical stub shaft 35 there is an eye. A hook fixed on a long handle can be introduced in the eye, which is rotated by turning the handle. This method of mechanically driving the awning is often dangerous, for a vehicle body can be damaged by the hook.

In the collapsible awning according to the invention, on the lower end of the vertical stub shaft 35, there is provided a coupling device 11. A cylindrical casing 36 is suspended around the lower end of the vertical stub shaft 35. The cylindrical casing and vertical stub shaft can take little directional variations from the vertical position. This cylindrical casing 36 is provided with one or more guiding grooves 37 in which can be introduced horizontal pins 38 fixed to the upper end of the handle 9.

The guiding grooves 37 start at the lower end of said cylindrical casing 36 and go upward in a vertical direction before taking a horizontal move and then again a vertical downward direction.

When the upper end of handle 9 is introduced within the cylindrical casing 36, the horizontal pins 38 of the handle 9 are introduced within the opening of said guiding grooves 37. The pins follow the groove design from the lower end of the grooves, going through the horizontal parts and then downward to lie in the closed extremity of said guiding grooves 37. A small upward movement of said handle 9 is followed by a rotation in the direction of the guiding grooves 37 before the handle can be suspended in a vertical position in extension of the vertical shaft 35 of said driving device.

By further rotating the handle 9 clockwise or counterclockwise, without upward or downward movement, vertical stub shaft 35 rotates in the same direction as the handle, turning the rolling shaft 2 in the required direction.

Figure 8:
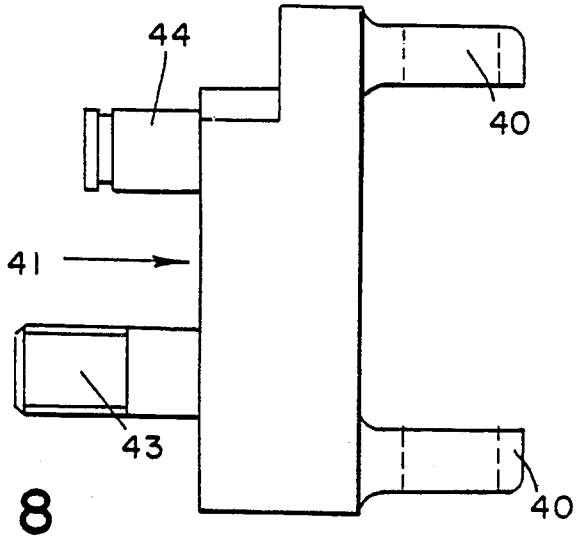
FIG. 8 is a vertical view of a vertical mounting hinge on which one of the stretching arms of a collapsible awning is fixed.
Figure 9:
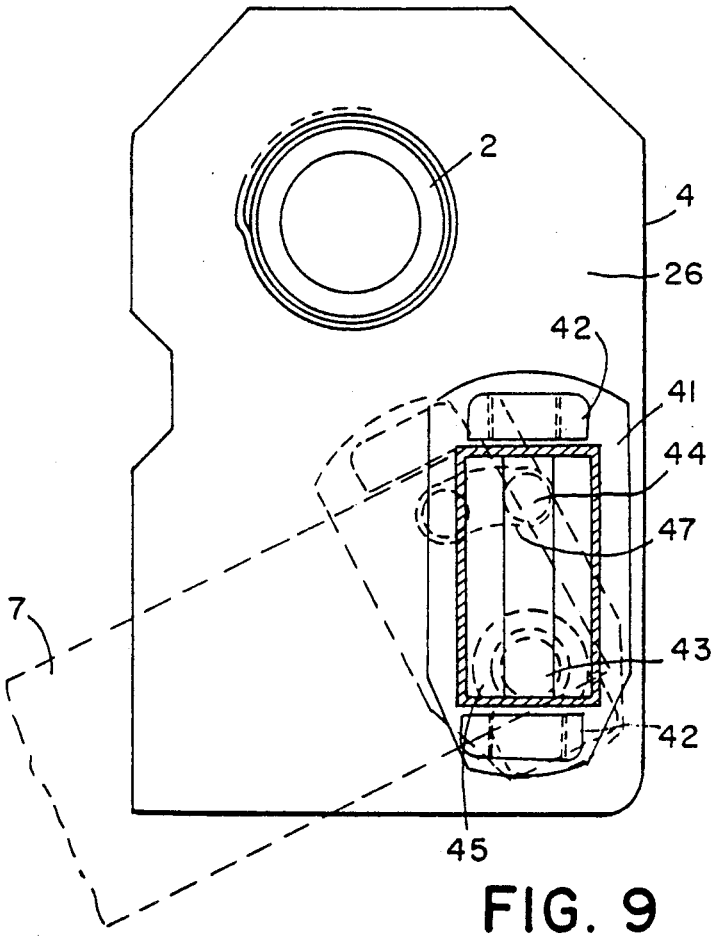
FIG. 9 is a schematic view of an awning case side wall of a collapsible awning according to the invention.

Another feature of the collapsible awning according to the invention concerns the vertical mounting hinges 41 connecting the stretching arms 7 to the side plate 26 of the awning box (FIGS. 1, 8 and 9).

In the described example of a collapsible awning according to the invention stretching arm parts 7 have rectangular hollow sections (FIG. 9). Vertical mounting hinges 41 (FIG. 8) are fixed to arm parts 7 by introducing the two fingers 40 of the vertical mounting hinges 41 within the hollow rectangular sections of the stretching arm parts 7, joined together by bolts 42.

The vertical mounting hinges 41 are characterized by two extension pins, a rotating pin 43 and a guiding pin 44. The stretching arm parts 7 rotate around the axis of the pivot pin 43 according to the position of the front lead rail profile 3. A guiding pin 44 slides within a groove 47 in the side plate 26 of the awning box while the stretching arm parts 7 rotate around the axis of the pivot pin 43 within a bearing 45 of the side plate 26.

Figure 10:
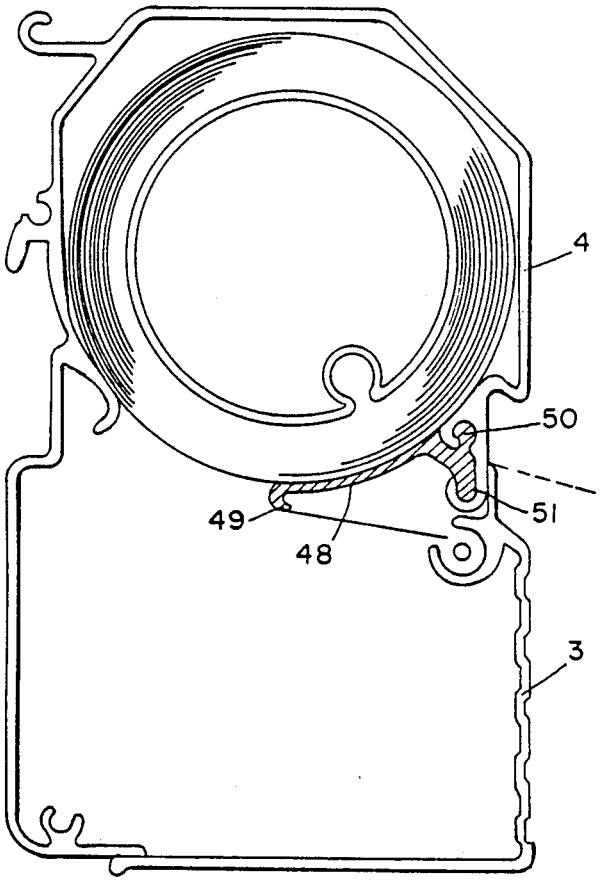
FIG. 10 is a schematic view of another embodiment of a collapsible awning using a protecting profile.

An improvement on the collapsible awning according to the invention uses a main awning box plate 4 assembled of two or more protecting profiles as represented in FIG. 10. Near the outise plate 4 of the awning box, a protecting profile 48 is introduced after mounting the rolling shaft 2 with the woven fabric 1. This profile 48 is concave according to the radius of the rolling shaft 2 when it is supporting the woven fabric 1 completely rolled up, giving a protection to said rolled woven fabric and avoiding any disturbing when the woven fabric is unrolled.

At one end of said protecting profile 48 there is a round part 49 which makes the unrolling easier, particularly, for example, for large awning cases to avoid that the rolling shaft would bend under its weight, what will create difficulties to roll up and unroll the woven fabric. The other end of said protecting profile 48 is provided with two ribs 50, 51 which are introduced in corresponding grooves in said main awning box plate 4. A round rib 50 is used as articulation when protecting profile 48 is introduced in the main awning box plate 4. A straight rib 51 fixes the protecting profile 48 to the awning box plate 4.

I claim:

1. A collapsible awning apparatus comprising an awning case, a rolling shaft mounted within the case, an awning having one end connected to the rolling shaft, a front lead rail connected to a second end of the awning, whereby, as the awning is rolled up on the shaft, the front lead rail is drawn toward the shaft and toward the awning case in which the shaft is mounted, first and second medially hinged stretching arms having first ends hinged to the case and having second ends connected to the front lead rail for stretching the awning when the awning is in the deploy position and for folding about the medial hinges when the awning is in the roll-up position, the front lead rail having an angular profile for closing the case when the awning is rolled up on the shaft, drawing the front lead rail up against the case, a step mounted on the front lead rail and a locking device mounted within the case and slidable between first, second and third positions wherein a latch of the locking device opposes the step, disengages the step and engages the step, respectively in the first, second and third positions, the step and latch having complementary slopes to move the locking device from the first position into the second and the third position upon drawing the lead rail and the step against the case as the awning is rolled up on the shaft and permitting the locking device to move into the third position when the front lead rail contacts the case, and lugs on the shaft for engaging the locking device and lifting the locking device into a second position when the awning is unrolled to release the step and for permitting the locking device to move into the first position as the step moves away from the locking device during unrolling of the awning from the shaft.

2. The collapsible awning of claim 1, further comprising vertical supports connected to the front rail and extending downward therefrom for supporting the front rail.

3. The collapsible awning of claim 1, wherein the stretching arms have vertical mounting hinges at the first ends for connecting to sides of the case, each mounting hinge having a first pivot pin for connecting to an aperture in an end of the case and a second guide pin for mounting in a groove in an end of the case, the guide pin and the groove limiting vertical movement of the stretching arms around the pivot pin.

4. The collapsible awning of claim 1, further comprising a gearbox connected to an end of the case, a first gear in the gearbox connected to an end of the shaft, a second gear in the gearbox, a vertical stub shaft connected to the second gear, a casing connected to a bottom end of the vertical sub shaft, the casing having a recess for receiving an upper end of a handle, the casing having a guiding groove extending upward from a lower end of the casing in a vertical direction, and then extending horizontally and then downward vertically toward a lower end of the casing, the groove ending at a position spaced from the lower end of the casing, the upper end of the handle being configured for fitting within the recess of the casing and having a pin extending horizontally from the upper end of the handle, the pin fitting within the groove and sliding upward, over and downward in the groove as the upper end of the handle is inserted in the casing for connecting the upper end of the handle to the casing to turn the stub shaft for turning the second gear in the gearbox.

5. The collapsible awning of claim 1, wherein the awning case further comprises a protecting profile connected to the case and extending into the case and partially beneath the roller for supporting the awning when rolled up, the protecting profile having a rounded portion remote from the connection between the case and the projecting profile, the rounded portion contacting the awning fabric as the awning is rolled and unrolled.

6. The collapsible awning of claim 5, wherein the protecting profile is connected to the case by first and second ribs on one end of the profile which connect with first and second complementary grooves in an edge of the awning case near an opening thereof, the first rib being a round rib fitting within a round groove and the second rib being a straight rib fitting within a straight-sided groove for supporting the projecting profile cantilevered under the roller.

7. The collapsible awning of claim 1, wherein the awning case has a mounting connection on a side of the case away from an opening in the case through which the awning projects when deployed, a mounting bracket connected to the case mounting connection, the mounting bracket comprising a profile having a first vertical portion and a second horizontal portion, the first vertical portion having an upper section connected to the awning case and having a lower section for connection to an upper portion of a vehicle body, the horizontal portion having a first section connected to an upper section of the vertical portion and having a second section which is curved for mounting on a vehicle body roof.

8. The collapsible awning of claim 7, wherein the lower section of the vertical portion is curved complementary to a curvature of an upper wall of a vehicle body, and wherein the first section of the horizontal portion is permanently attached to the vertical portion, and wherein a lower section of the vertical portion has an extension beneath the awning case, and wherein an upper section of the vertical portion has an extension fitting within a groove in an upper portion of a rear wall of the awning case.

9. The collapsible awning apparatus of claim 7, wherein an upper section of the first vertical portion has a support extension extending toward the horizontal portion and further has upward opening grooves in the support extension, and wherein the first section of the vertical portion has an articulation rib extending toward the horizontal portion, and wherein the apparatus of claim 7, further comprises an adapting profile having a groove for receiving the articulation rib and having a downward projecting rib for fitting within the upward opening groove in the support section of the vertical portion for holding the adapting profile in fixed adjustment with the vertical portion for accommodating varied vehicle bodies.

10. The collapsible awning of claim 1, wherein the locking device further has a spring connected to a pin and to a sliding finger for urging the locking device into the first position, the latch of the locking device engages the step which moves the pin and latch upward against spring pressure into the second position of the locking device; as the step is further drawn into the case with the awning, the spring urges the pin and latch downward into the third position into locking contact with the step to hold the step and its connected front rail in closed position with relation to the awning case, and wherein the sliding finger has a hook at its upper end for engaging lugs on the shaft, the hook having a downward and rearward sloping surface whereby the lugs slide along the sloping surface when the roller moves the lugs in an awning winding direction, and the hook having an engaging surface for engaging the lugs and lifting the hook and the sliding finger upward into the second position against spring force when the roller turns the lugs in the awning unrolling-deploying direction, the latch disengaging from the step as the hook lifts the sliding finger to the second position to permit the step and the front rail connected to the step to move away from the awning case as the roller turns for unrolling the awning.

11. A collapsible awning comprising an awning case having a rear, upper and front wall and having end walls, a roller mounted within the rear upper and front walls and between the side plate of the awning case, an awning having a first end connected to the roller and having a second end remote from the roller, a front rail connected to the second end of the awning, first and second stretching arms connected between the awning case and the front rail, the stretching arms being medially hinged and hingedly mounted to and foldable within the awning case when the awning is rolled on the roller and when the front rail is drawn against the awning case, each of the stretching arms having a medial hinge connecting first and second sections for folding and a mounting hinge connected between the second section and the awning case, the mounting hinge having fingers for connecting an inward end of the second section to the mounting hinge and having first and second generally horizontally extension pins, the first extension pin being a pivot pin and the second extension pin being a guiding pin, the pivot pin being mounted in a bearing in a side plate of the awning case and the guiding pin being mounted in an arcuate groove in the side plate of the awning case, the groove defining and extending along a radius of curvature about the pivot pin, whereby the groove in cooperation with the guiding pin permits limited movement of the stretching-arm about a horizontal axis through the pivot pin.

12. A collapsible awning comprised of a housing having rear, top and front walls and end walls and a roller supported between the end walls within the housing, an awning having a first end connected to the roller and having a second end positionable remote from the roller, a mounting bracket for mounting the awning case on a vehicle, the mounting bracket having a generally vertical portion connected to the awning case having an articulation rib near an upper end thereof and a support extension below the articulation rib, and a generally horizontal portion having a first end permanently connected to the support extension of the vertical portion and having a second end configured for connecting to a vehicle, a lower end of the vertical portion configured for connecting to the vehicle body, wherein the support extension has at least one upward extending groove, wherein the lower end of the vertical portion has an arcuate form on a side thereof and wherein the end of the horizontal portion for connection to the vehicle body has a generally arcuate shape on a side thereof away from the awning case, further comprising an adapting profile having a proximal end configured for fitting between the articulation rib and support extension of the vertical portion, for fitting within one of the grooves of the support extension and extending upward therefrom to beneath the vertical end on the articulation rib to rigidly entrap the adapting profile when the distal end of the adapting profile is connected to a vehicle body.

* * * * *